US011417988B1

(12) United States Patent
Chang et al.

(10) Patent No.: US 11,417,988 B1
(45) Date of Patent: Aug. 16, 2022

(54) ELECTRIC CONNECTOR

(71) Applicant: JESS-LINK PRODUCTS CO., LTD., New Taipei (TW)

(72) Inventors: Hsu-Feng Chang, New Taipei (TW); Ya-Fen Kao, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 0 days.

(21) Appl. No.: 17/330,050

(22) Filed: May 25, 2021

(30) Foreign Application Priority Data

Apr. 23, 2021 (TW) ..... 110114760

(51) Int. Cl.

| | |
|---|---|
| ***H01R 13/62*** | (2006.01) |
| ***H01R 13/627*** | (2006.01) |
| ***H01R 12/78*** | (2011.01) |
| ***H01R 13/40*** | (2006.01) |
| ***H01R 12/65*** | (2011.01) |

(52) U.S. Cl.
CPC ..... *H01R 13/6271* (2013.01); *H01R 12/65* (2013.01); *H01R 12/78* (2013.01); *H01R 13/40* (2013.01); *H01R 13/6275* (2013.01)

(58) Field of Classification Search
None
See application file for complete search history.

(56) References Cited

U.S. PATENT DOCUMENTS

| | | | | |
|---|---|---|---|---|
| 10,263,349 | B2 * | 4/2019 | Phillips | H01R 12/7029 |
| 10,770,836 | B2 * | 9/2020 | Henry | H01R 13/6272 |
| 10,855,028 | B1 * | 12/2020 | Henry | H01R 13/6272 |
| 2021/0367379 | A1 * | 11/2021 | Cao | H01R 13/6275 |

FOREIGN PATENT DOCUMENTS

| | | |
|---|---|---|
| CN | 205863538 U | 1/2017 |
| TW | M614874 U | 7/2021 |

OTHER PUBLICATIONS

Office Action dated Jan. 10, 2022 of the corresponding Taiwan patent application No. 110114760.

* cited by examiner

*Primary Examiner* — Ross N Gushi
(74) *Attorney, Agent, or Firm* — Chun-Ming Shih; HDLS IPR Services

(57) ABSTRACT

An electric connector includes an insulative seat, a circuit board, a flat cable, a latch and an actuating slider. The insulative seat includes a main body and a cover. An action room and a sliding trough are formed between the cover and the main body. The circuit board is received in the main body. The circuit board is extended with a tongue having printed terminals. An end of the flat cable is embedded in the main body and electrically connected to the printed terminals. The latch is received in the action room. The latch has a root with an insert and an extremity with a hook, respectively. The latch has an actuating portion with an elastic member. The actuating slider is received in the insulative seat and is slidable along the sliding trough. The acting slider pushes the actuating portion away from the cover to make the hook retract.

10 Claims, 11 Drawing Sheets

ELECTRIC CONNECTOR

BACKGROUND

Technical Field

The disclosure relates to an electric connector, particularly to an electric connector with a latch.

RELATED ART

Some of related-art electric connectors are disposed with a movable latch at the male connector. When a female connector is connected, the female connector is secured by the latch to firmly connect with the male connector to prevent the male and female connectors from unexpectedly separating.

Such a male electric connector with a latch has an insulative seat and a circuit board received in the insulative seat by an injection molding process. A cover is added after the latch has been assembled. An end of the latch is fixed on the insulative seat so as to make the latch swayable to securely connect with or separate from the female connector. In order to avoid the end of the latch, which is inserted into the insulative seat, from contacting the circuit board in the insulative seat, the thickness of the insulative seat must be increased for facilitate the forming of an insert trough. This makes volume of the electric connector hard to be reduced.

SUMMARY

The disclosure provides an electric connector with a latch.

The electric connector of the disclosure includes an insulative seat, a circuit board, a flat cable, at least one flexible arm latch and an actuating slider. The insulative seat includes a main body and a cover covering a side of the main body. An action room and a sliding trough are formed between the cover and the main body. The action room communicates with the sliding trough. The cover has a through hole communicating with the action room. The circuit board is received in the main body. A side of the circuit board is extended with a tongue. The tongue is exposed from the main body and printed with multiple printed terminals. An end of the flat cable is embedded in the main body and connected to the circuit board to be electrically connected with the printed terminals. The flexible arm latch is received in the action room. Two ends of the flexible arm latch are a root and an extremity, respectively. The root is provided with an insert. The extremity is provided with a hook. A side of the flexible arm latch is extended with an actuating portion. The insert is inserted into the cover to be fixed so as to make the flexible arm latch swayable in the action room with respect to the root as a center. The actuating portion has an elastic member extended toward the main body. The hook passes the through hole to project from the cover. The actuating slider is received in the insulative seat and is slidable along the sliding trough. A moving path of the actuating slider interferes with the actuating portion. The acting slider is capable of sliding to push the actuating portion away from the cover to make the hook retract to an unlocking position in the through hole.

In the electric connector of the disclosure, the elastic member is capable of pushing the actuating portion toward the cover to make the hook return to a locking position projecting from the through hole.

In the electric connector of the disclosure, the cover is formed with an opening, and a part of the actuating slider protrudes from an outer surface of the cover through the opening.

In the electric connector of the disclosure, the actuating slider is formed with a pushing slant, a normal direction of the pushing slant is arranged toward the actuating portion and is deflected with an angle relative to a longitudinal direction of the sliding trough toward the main body, the actuating portion is formed with an actuated slant to abut against the pushing slant, a normal direction of the actuated slant is arranged toward the actuating slider and is deflected with an angle relative to the longitudinal direction of the sliding trough toward the cover.

In the electric connector of the disclosure, the actuating slider is connected with a stem, the stem passes through the sliding trough and is slidable along the sliding trough to push the actuating slider, the actuating slider pushes the actuating portion away from the cover to make the hook retract to the unlocking position, and the extremity of the stem projects from the insulative seat.

In the electric connector of the disclosure, the cover is disposed with a key corresponding to the actuating portion in position, and when the key is being pressed, the key moves toward the actuating portion to push the actuating portion away from the cover to make the hook retract to the unlocking position.

In the electric connector of the disclosure, the cover is formed with an opening, and the key is disposed in the opening.

In the electric connector of the disclosure, a side of the key is connected with a side of an inner edge of the opening, and the key is swayable relative to the opening.

In the electric connector of the disclosure, the cover covers the tongue and is arranged spacedly with the tongue.

In the electric connector of the disclosure, the flexible arm latch is a pair in number and arranged parallelly and spacedly, and the actuating portion is respectively connected with each flexible arm latch.

In the electric connector of the disclosure, the flexible arm latch is fixed to the cover by the insert in advance, and then the cover and the flexible arm latch are jointly installed to the main body. As a result, the structure for fixing the flexible arm latch is not required in the main body. The cover is not required to add any additional structure. Thus, a thickness of the main body and volume of the electric connector may be reduced.

In view of this, the inventors have devoted themselves to the above-mentioned related art, researched intensively and cooperated with the application of science to try to solve the above-mentioned problems. Finally, the disclosure which is reasonable and effective to overcome the above drawbacks is provided.

DETAILED DESCRIPTION

Figure 1:
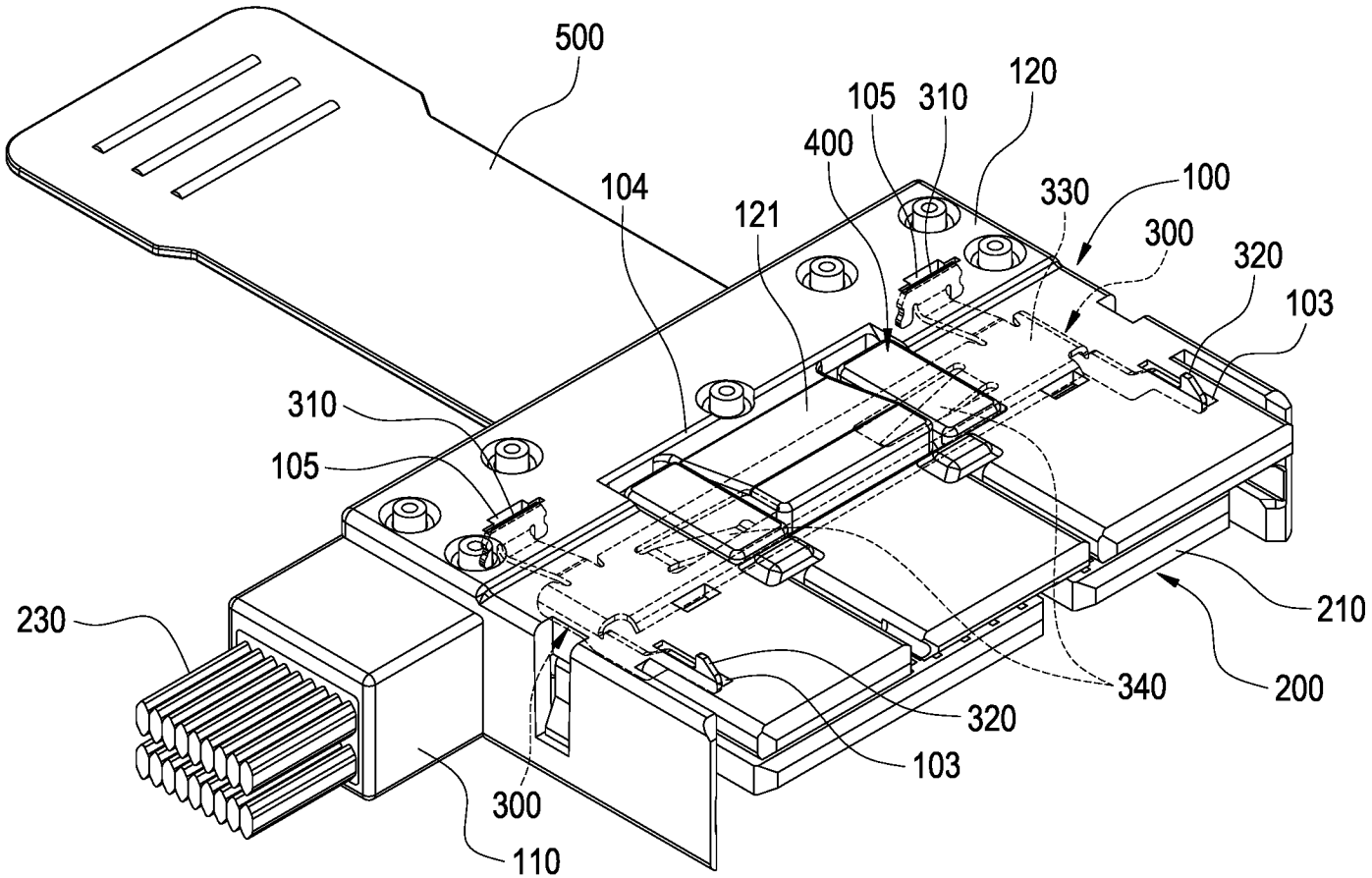
FIGS. 1 and 2 are two perspective schematic views of the electric connector of the disclosure.
Figure 2:
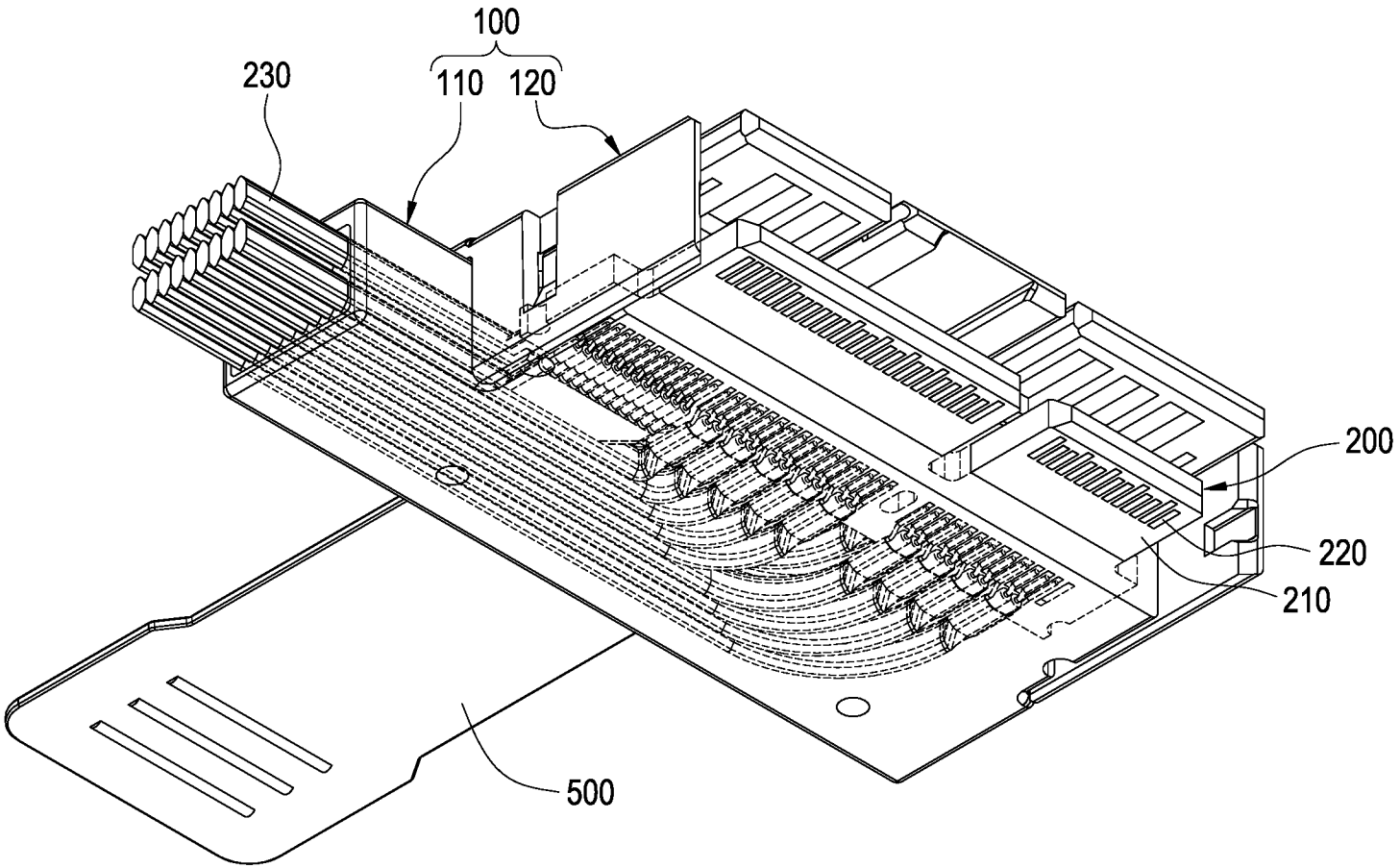

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIGS. 1-4. The disclosure provides an electric connector, which includes an insulative seat 100, a circuit board 200, a flat cable 230, at least one flexible arm latch 300 and an actuating slider 400.

Figure 3:
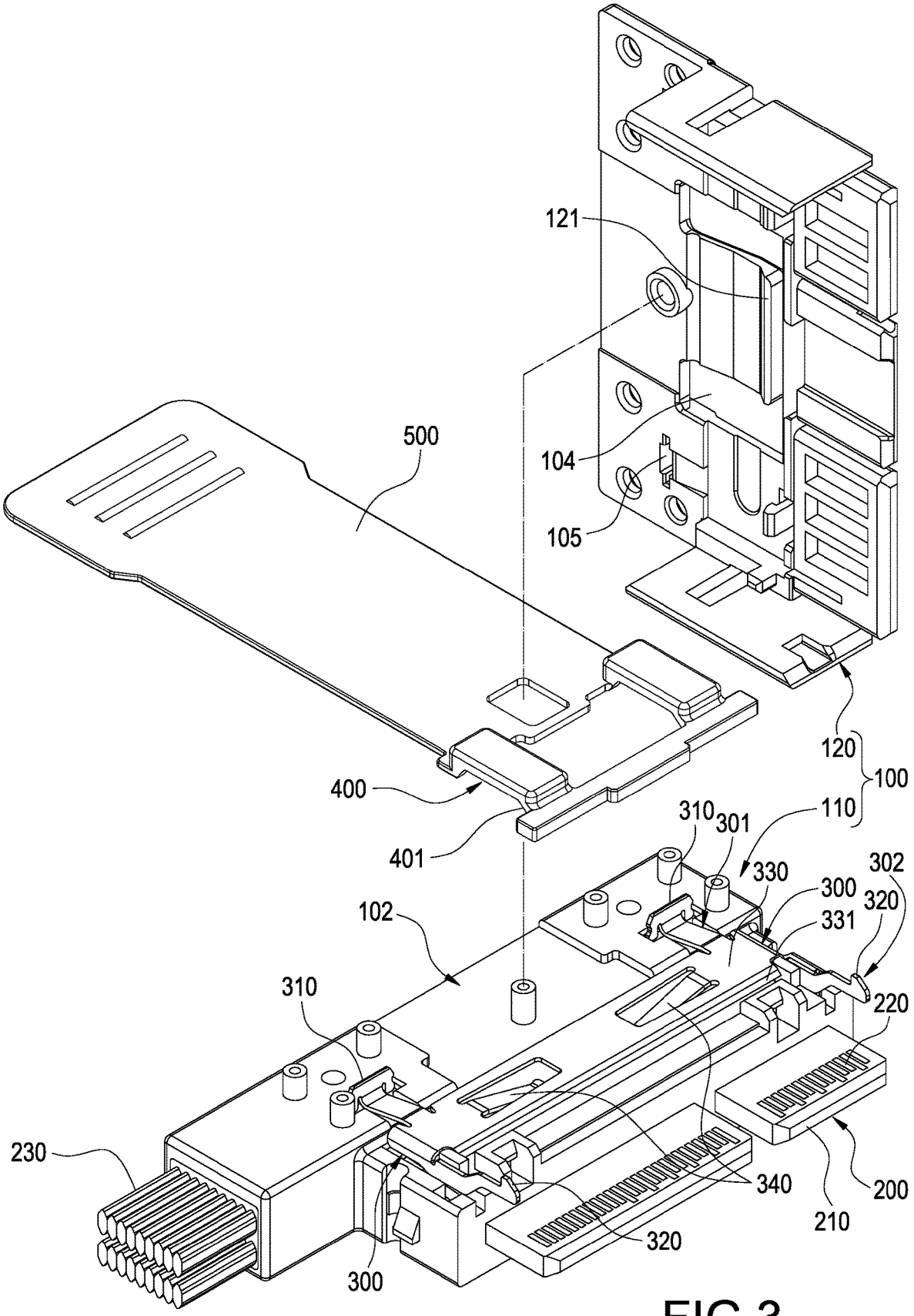
FIGS. 3 and 4 are two perspective exploded views of the electric connector of the disclosure.
Figure 4:
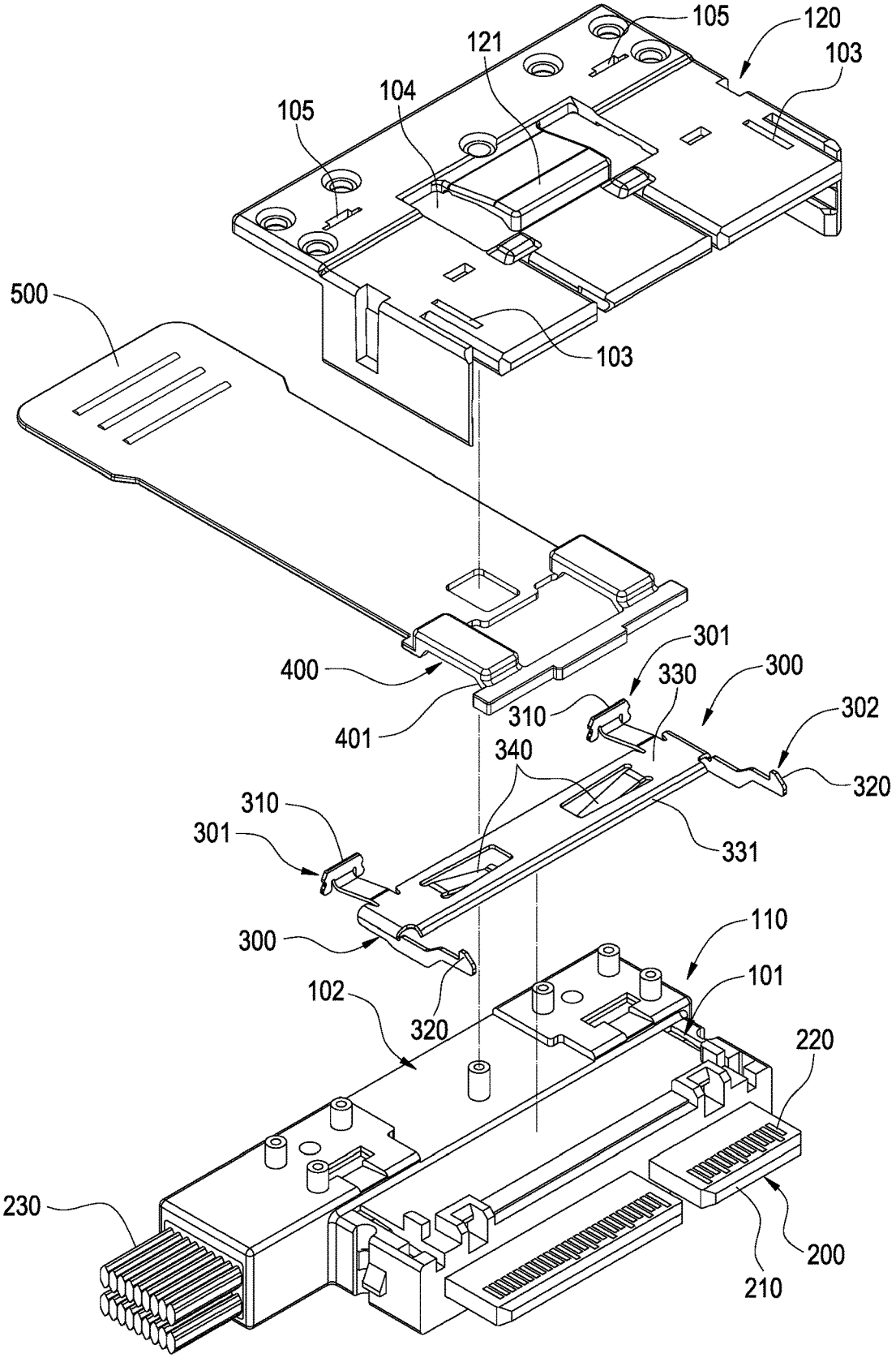
Figure 5:
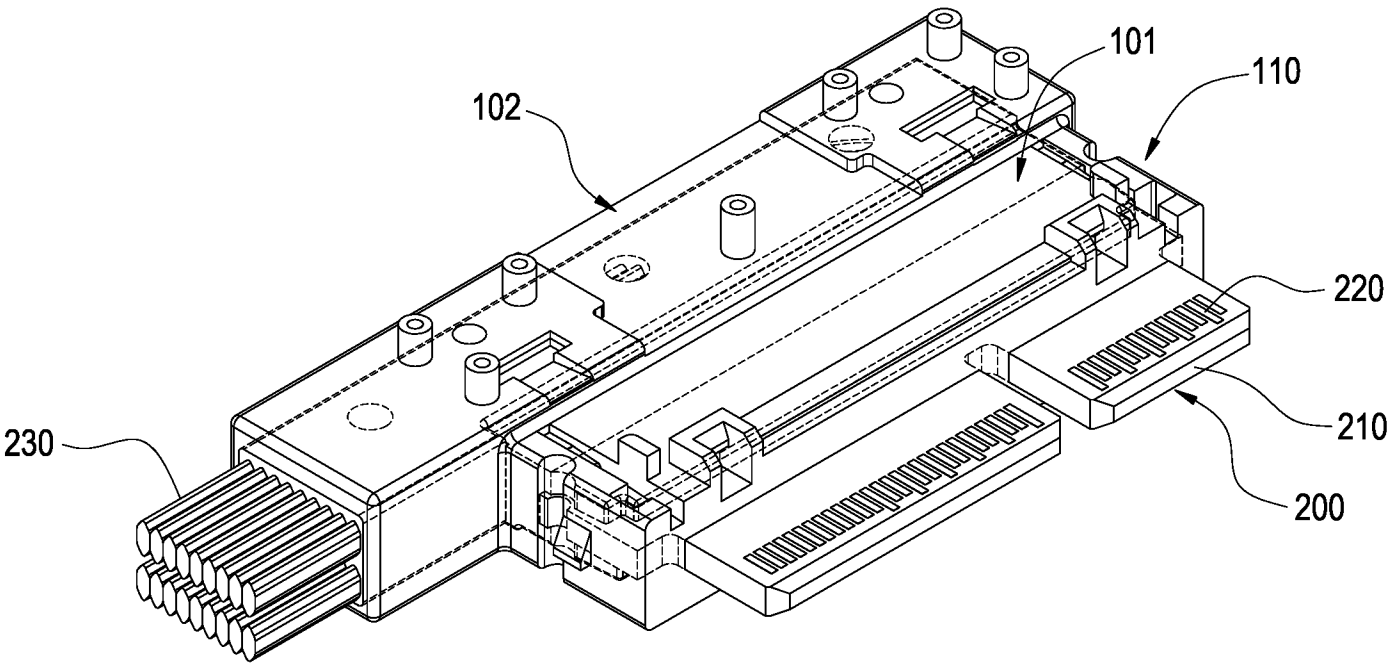
FIG. 5 is a perspective schematic view of the insulative seat of the electric connector of the disclosure.

Please refer to FIGS. 3-5. The insulative seat 100 includes a main body 110 and a cover 120. In this embodiment, the main body 110 is a plastic flat block and the cover 120 is a plastic lid. The cover 120 covers a side of the main body 110 and the cover 120 is fastened to the main body 110. An action room 101 and a sliding trough 102 are formed (enclosed) between the cover 120 and the main body 110. The action room 101 intersects and communicates with the sliding trough 102. The cover 120 is perforated to be formed with a through hole 103 communicating with the action room 101.

Figure 6:
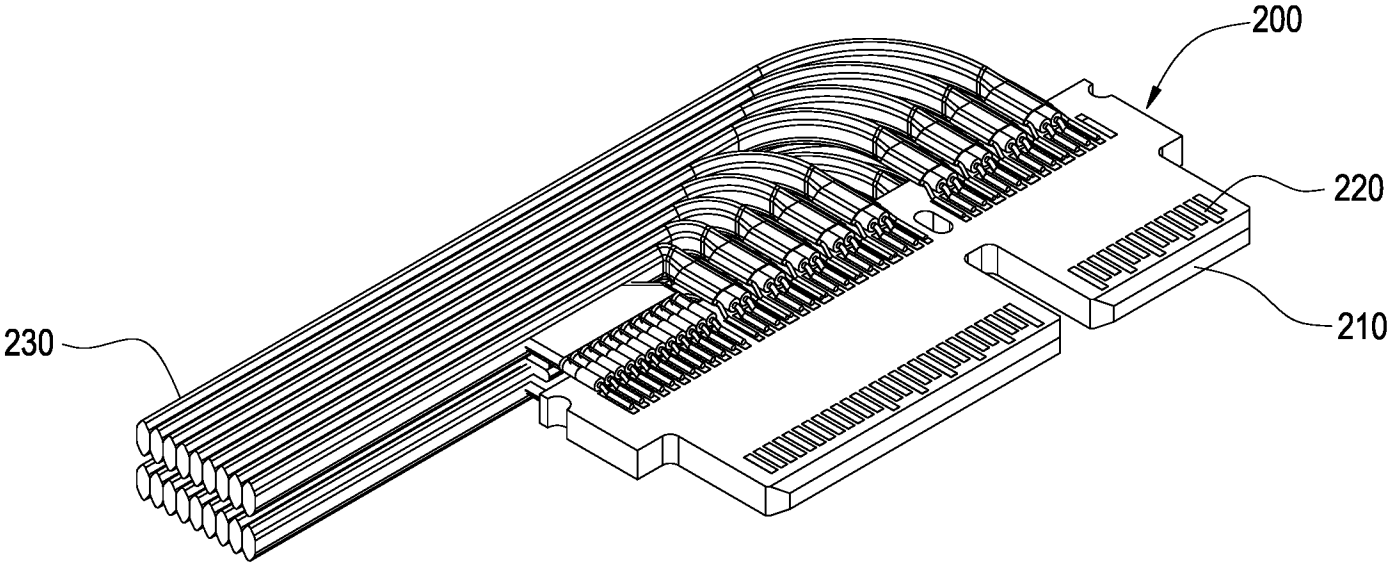
FIG. 6 is a perspective exploded view of the circuit board of the electric connector of the disclosure.

Please refer to FIGS. 4-6. The circuit board 200 is received (buried) in the main body 110 by an injection molding process. In detail, the circuit board 200 is placed in a mold, the plastic material is filled into the mold to form the main body 110 and the main body 110 covers the circuit board 200. A side of the circuit board 200 is extended with a tongue 210. The tongue 210 is exposed from the main body 110 and printed with multiple printed terminals 220. In this embodiment, the printed terminals 220 are disposed on two sides of the tongue 210. The cover 120 of the insulative seat 100 covers the tongue 210 and is disposed spacedly with the tongue 210.

Please refer to FIGS. 5 and 6. The flat cable 230 includes multiple wires in parallel. An end of the flat cable 230 is connected to the circuit board 200 to be electrically connected with the printed terminals 220. The end of the flat cable 230 is embedded in the main body 110 by an injection molding process. Therefore, the flat cable 230 is secured to prevent the flat cable 230 from falling off due to pulling Please refer to FIGS. 1-4 and 7-9. The flexible arm latch 300 is received in the action room 101. Two ends of the flexible arm latch 300 are a root 301 and an extremity 302, respectively. The root 301 is provided with an insert 310. The extremity 302 is provided with a hook 320. A side of the flexible arm latch 300 is extended with an actuating portion 330. The insert 310 is inserted into the cover 120 to be fixed so as to make the flexible arm latch 300 be swayable in the action room 101 with respect to the root 301 as a center. In some embodiments, the cover 120 is defined with a slot 105 for the insert 310 to be inserted. The actuating portion 330 is located at a communicating position between the sliding trough 102 and the action room 101. The hook 320 passes the through hole 103 to project from the cover 120. When the electric connector of the disclosure is connected with another electric connector correspondingly, falling off may be avoided by the hook 320 at a locking position fastening with another electric connector. An elastic member 340 is sandwiched between the actuating portion 330 and the main body 110. In the embodiment, the elastic member 340 is a flexible arm extended from the actuating portion 330 and pressing the main body 100, but not limited to this, for example, a spring or an elastic silicone/rubber block, etc., is also applicable.

Please refer to FIGS. 1-4. One embodiment of the disclosure is single flexible arm latch 300 and the actuating portion 330 extended from a side thereof. In some embodiments, the disclosure may include a pair of flexible arm latches 300 arranged parallelly and spacedly. The structure of the pair of flexible arm latches 300 is mirrored with each other and connects to the same actuating portion 330. In addition, the flexible arm latches 300, the actuating portion 330 and the elastic member 340 may be formed as a single piece by a single pressed metal sheet.

Please refer to FIGS. 1, 3, 4, 10 and 11. The actuating slider 400 is received in the communicating position between the sliding trough 102 and the action room 101 and is slidable along the sliding trough 102. A moving path of the actuating slider 400 interferes with the actuating portion 330. The actuating slider 400 is connected with a stem 500. The stem 500 passes through the sliding trough 102 and is slidable along the sliding trough 102. The extremity 302 of the stem 500 projects from a side of the insulative seat 100, which is opposite to the tongue 210. The stem 500 is slidable along the sliding trough 102. When the stem 500 is being pulled, the actuating slider 400 pushes the actuating portion 330 away from the cover 120 to make the flexible arm latch 300 sway with respect to the root 301 as a center to make the hook 320 retract into the through hole 103 to an unlocking position. When the stem 500 is released, the elastic member 340 pushes the actuating portion 330 toward the cover 120 to make the hook 320 move out of the through hole 103 to a locking position. Please refer to FIG. 1. To prevent the moving path of the actuating slider 400 from interfering with the action of the hook 320, a side of the actuating portion 330 is located at each flexible arm latch 300 to make the moving path of the actuating slider 400 avoid the sway path of the hook 320.

In detail, the actuating portion 330 is formed with an actuated slant 331 for abutting against the actuating slider 400. A normal direction 331*n* of the actuated slant 331 is aslant arranged toward the actuating slider 400. In particular, the normal direction 331*n* of the actuated slant 331 is deflected with an angle 401*a* relative to a longitudinal direction 1021 of the sliding trough 102 toward the cover 120. The actuating slider 400 is formed with a pushing slant 401 for abutting against the actuating portion 330. A normal direction 401*n* of the pushing slant 401 is aslant arranged toward the actuating portion 330. In particular, the normal direction 401*n* is deflected with an angle 331*a* relative to the longitudinal direction 1021 of the sliding trough 102 toward the main body 110. Thus, when the actuating slider 400 is guided by the sliding trough 102 to move along a transversal direction of the insulative seat 100, a component force along a normal direction of the insulative seat 100 is generated by the pushing slant 401 or the actuated slant 331 so as to push the flexible arm latch 300. One embodiment of the disclosure may utilize the pushing slant 401 or the actuated slant 331 to solely generate a component force along the normal direction of the insulative seat 100. In some embodiments, the pushing slant 401 and the actuated slant 331 are arranged to abut against to each other to stably exert a force.

In the embodiment, the cover 120 is perforated to be formed with an opening 105 corresponding to the communicating position between the sliding trough 102 and the action room 101. A part of the actuating slider 400 protrudes from an outer surface of the cover 120 through the opening 105. Therefore, the actuating slider 400 is received in the cover 120 to reduce the overall thickness of the electric connector.

Figure 7:
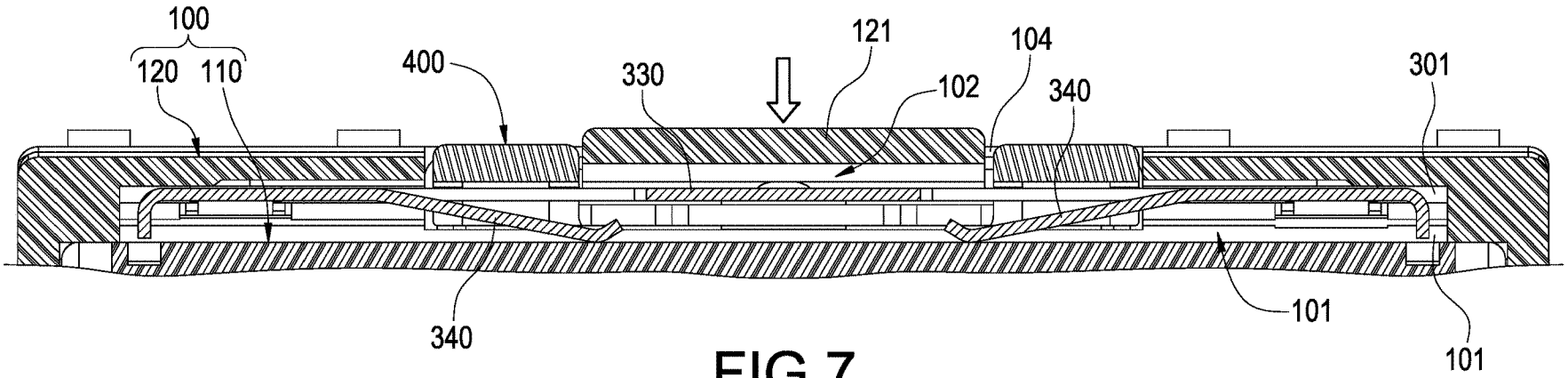
FIG. 7 is a transversal cross-sectional view of the electric connector of the disclosure.
Figure 8:
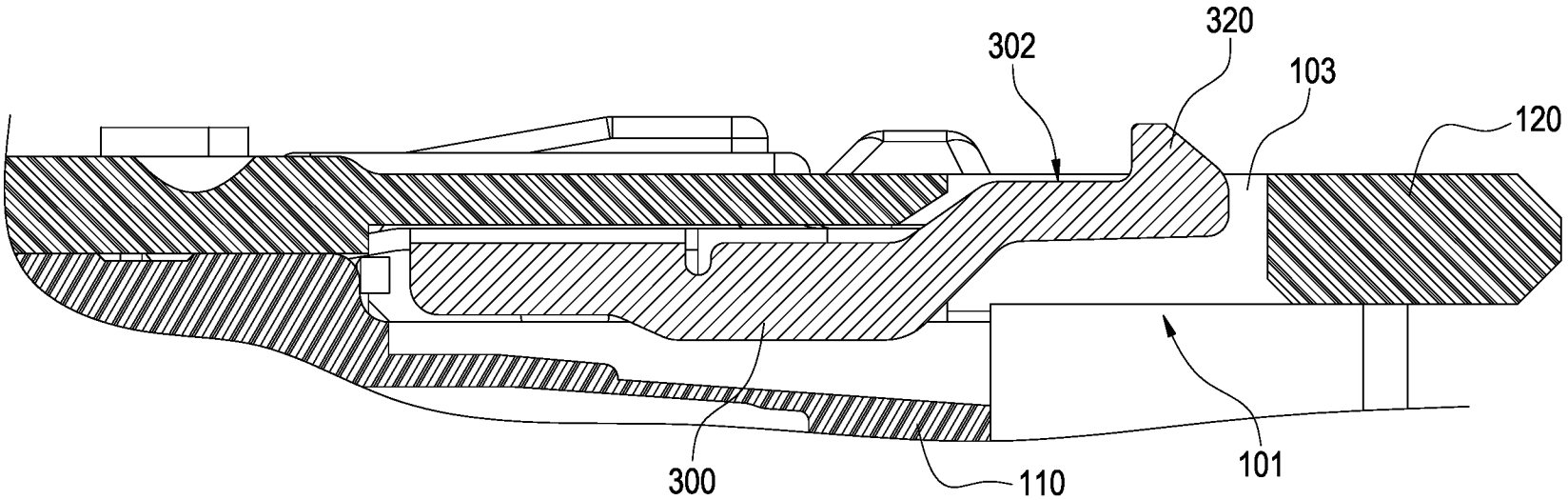
FIGS. 8 and 9 are two longitudinal cross-sectional views of the electric connector of the disclosure.
Figure 9:
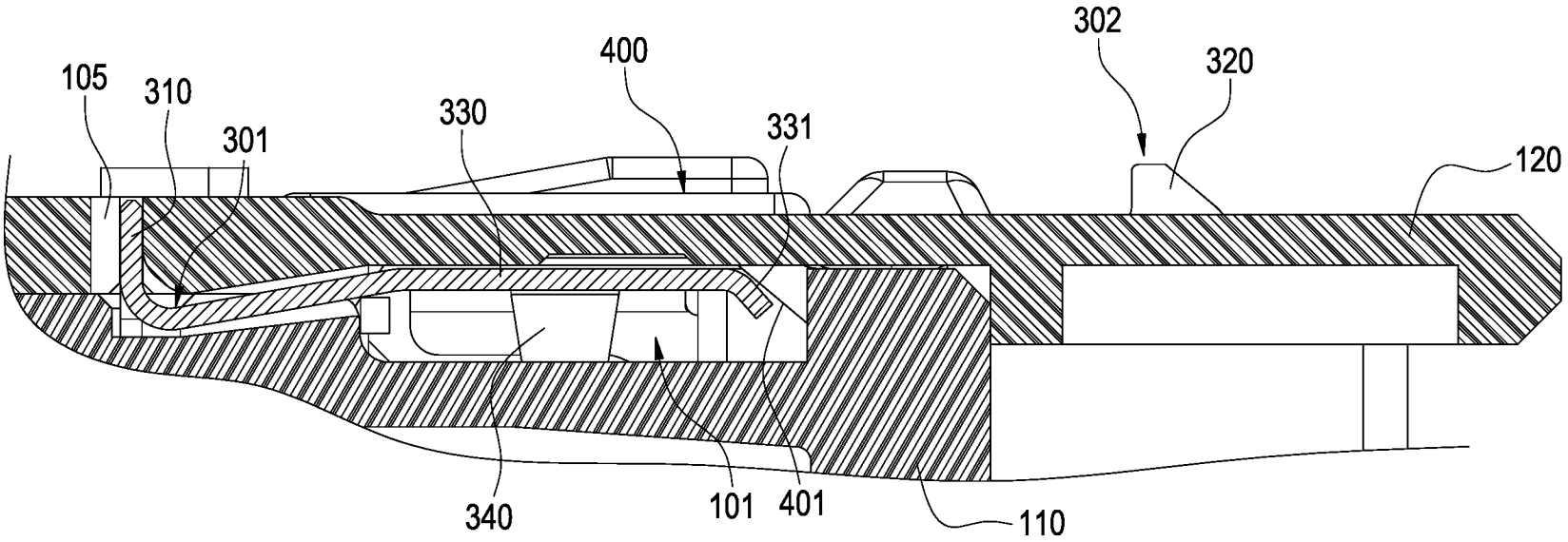
Figure 10:
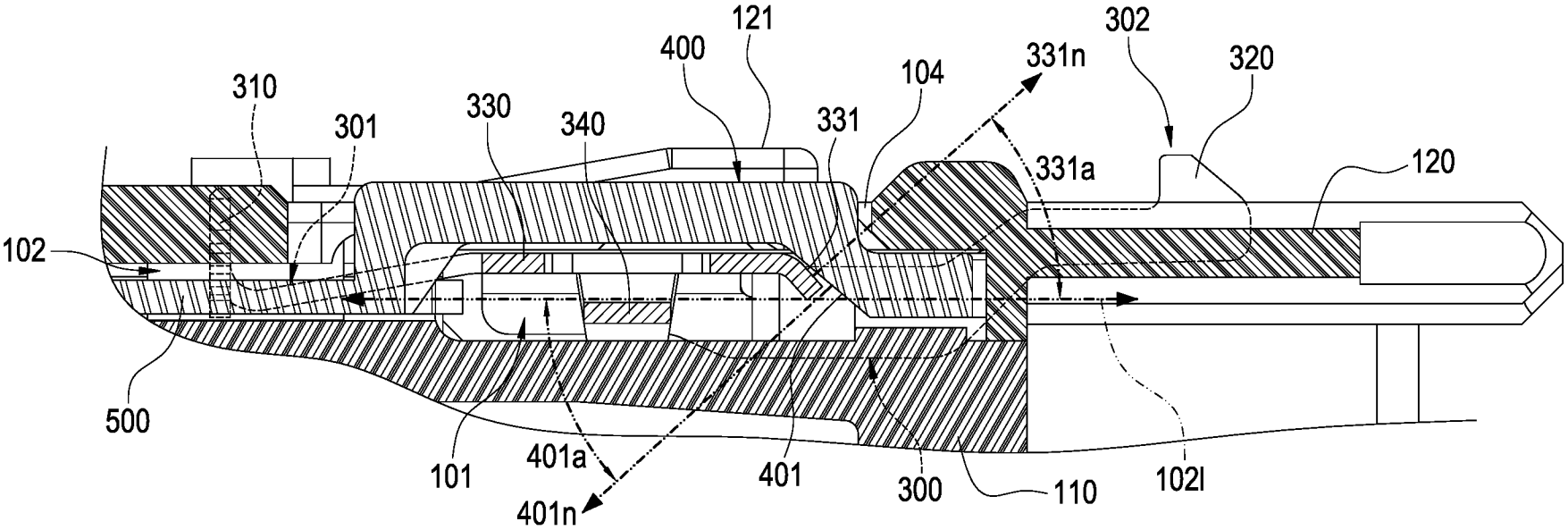
FIGS. 10 and 11 are two schematic views of the electric connector of the disclosure in use.
Figure 11:
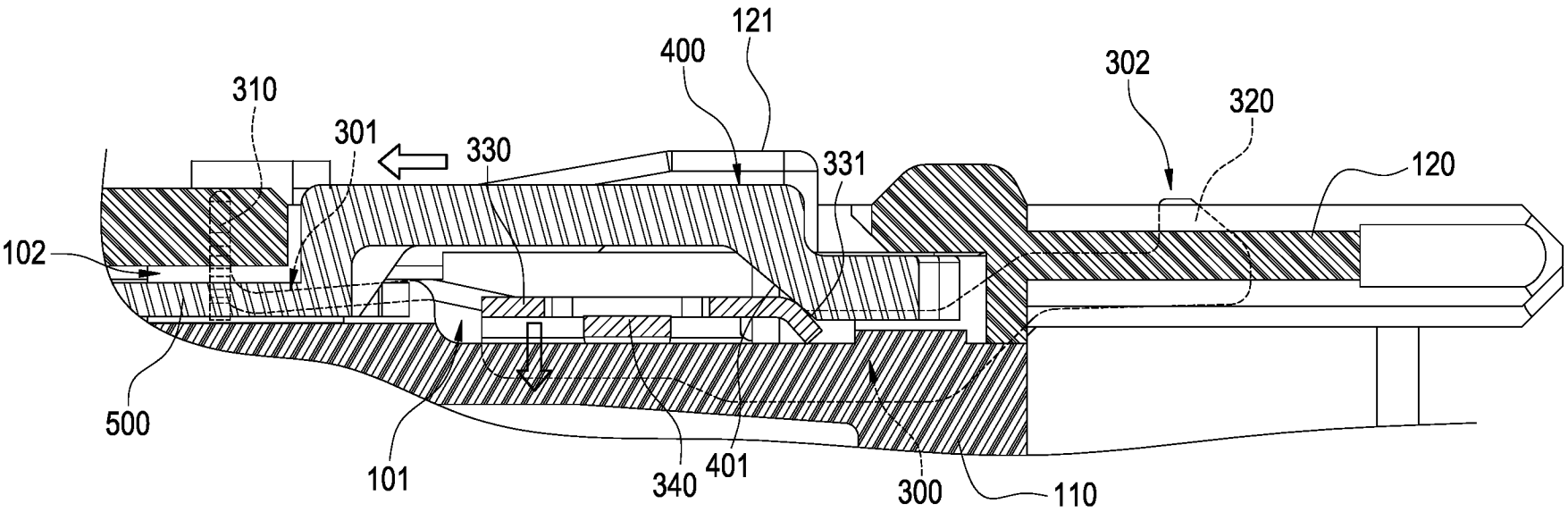

Please refer to FIGS. 4 and 7. In the embodiment, the cover 120 may be movably disposed with a key 121 corresponding to the actuating portion 330 in position. The key 121 may be moved toward the actuating slider 400 to make the actuating slider 400 be pushed by the key 121 so that the actuating slider 400 pushes the actuating portion 330 away from the cover 120 to make the hook 320 retract to an unlocking position. In some embodiments, the key 121 is disposed in the opening 105 to reduce the overall thickness of the electric connector. A side of the key 121 is connected with a side of an inner edge of the opening 105 to make the key 121 sway relative to the side.

In the electric connector of the disclosure, the flexible arm latch 300 is fixed to the cover 120 by the insert 310 in advance, and then the cover 120 and the flexible arm latch 300 are jointly installed to the main body 110. As a result, the structure for fixing the flexible arm latch 300 is not required in the main body 110. The cover 120 is not required to add any additional structure. Thus, a thickness of the main body 110 and volume of the electric connector may be reduced.

While this disclosure has been described by means of specific embodiments, numerous modifications and variations could be made thereto by those skilled in the art without departing from the scope and spirit of this disclosure set forth in the claims.

What is claimed is:

1. An electric connector, comprising:

an insulative seat, comprising a main body and a cover covering a side of the main body, wherein an action room and a sliding trough are disposed between the cover and the main body, the action room communicates with the sliding trough, and a through hole is disposed to perforate the cover and communicates with the action room;

a circuit board, received in the main body, a tongue extended from a side thereof, and the tongue exposed from the main body and printed with multiple printed terminals;

a flat cable, an end thereof embedded in the main body and connected to the circuit board to be electrically connected with the printed terminals;

at least one flexible arm latch, received in the action room, two ends of the flexible arm latch being a root and an extremity respectively, an insert disposed on the root, a hook disposed on the extremity, an actuating portion extended from a side of the flexible arm latch, the insert being inserted into the cover to be fixed to make the flexible arm latch be swayable in the action room with respect to the root as a center, the actuating portion comprising an elastic member extended toward the main body, and the hook passing the through hole to project from the cover; and an actuating slider, received in the insulative seat, slidable along the sliding trough, a moving path of the actuating slider interfering the actuating portion, wherein the acting slider is slidable to push the actuating portion away from the cover to make the hook retract to an unlocking position in the through hole.

2. The electric connector of claim 1, wherein the elastic member pushes the actuating portion toward the cover to make the hook return to a locking position projecting from the through hole.

3. The electric connector of claim 1, wherein an opening is disposed to perforate the cover, and a part of the actuating slider protrudes from an outer surface of the cover through the opening.

4. The electric connector of claim 1, wherein a pushing slant is disposed on the actuating slider, a normal direction of the pushing slant is arranged toward the actuating portion and is deflected with an angle relative to a longitudinal direction of the sliding trough toward the main body, an actuated slant is disposed on the actuating portion to abut against the pushing slant, a normal direction of the actuated slant is arranged toward the actuating slider and is deflected with an angle relative to the longitudinal direction of the sliding trough toward the cover.

5. The electric connector of claim 1, wherein the actuating slider is connected with a stem, the stem passes through the sliding trough and is slidable along the sliding trough to push the actuating slider, and the actuating slider pushes the actuating portion away from the cover to make the hook retract to the unlocking position, and the extremity of the stem projects from the insulative seat.

6. The electric connector of claim 1, wherein a key is disposed on the cover corresponding to the actuating portion in position, and when the key is being pressed, the key moves toward the actuating portion to push the actuating portion away from the cover to make the hook retract to the unlocking position.

7. The electric connector of claim 6, wherein an opening is disposed to perforate the cover, and the key is disposed in the opening.

8. The electric connector of claim 7, wherein a side of the key is connected with a side of an inner edge of the opening, and the key is swayable relative to the opening.

9. The electric connector of claim 1, wherein the cover covers the tongue and is arranged spacedly with the tongue.

10. The electric connector of claim 1, wherein the flexible arm latch is a pair in number and arranged parallelly and spacedly, and the actuating portion is respectively connected with each flexible arm latch.

* * * * *